US007238000B2

(12) United States Patent
Elsmark

(10) Patent No.: US 7,238,000 B2
(45) Date of Patent: Jul. 3, 2007

(54) PNEUMATIC HIGH SPEED MOTOR WITH PRESSURE ACTIVATED SPEED GOVERNOR

(75) Inventor: Karl Johan Lars Elsmark, Saltsjö-Boo (SE)

(73) Assignee: Atlas Copco Tools AB, Nacka (SE)

( * ) Notice: Subject to any disclaimer, the term of this patent is extended or adjusted under 35 U.S.C. 154(b) by 0 days.

(21) Appl. No.: 10/531,153

(22) PCT Filed: Oct. 10, 2003

(86) PCT No.: PCT/SE03/01575

§ 371 (c)(1),
(2), (4) Date: Apr. 12, 2005

(87) PCT Pub. No.: WO2004/035993

PCT Pub. Date: Apr. 29, 2004

(65) Prior Publication Data

US 2005/0265821 A1 Dec. 1, 2005

(30) Foreign Application Priority Data

Oct. 14, 2002 (SE) ..... 0203022

(51) Int. Cl.
*F03D 7/00* (2006.01)

(52) U.S. Cl. ..... 415/25; 415/30; 415/36; 415/904

(58) Field of Classification Search ..... 415/25, 415/30, 36, 904
See application file for complete search history.

(56) References Cited

U.S. PATENT DOCUMENTS

| | | | | |
|---|---|---|---|---|
| 3,128,989 | A * | 4/1964 | Allingham | 415/36 |
| 4,671,068 | A * | 6/1987 | Moody et al. | 60/602 |
| 4,776,752 | A | 10/1988 | Davia | |
| 5,314,299 | A | 5/1994 | Jacobsson | |
| 6,241,464 | B1 | 6/2001 | Huffaker et al. | |

* cited by examiner

*Primary Examiner*—Igor Kershteyn
(74) *Attorney, Agent, or Firm*—Frishauf, Holtz, Goodman & Chick, P.C.

(57) ABSTRACT

A pneumatic high speed motor includes a stator housing, a rotor journalled in the stator housing, and a pressure air inlet passage. A speed governor for the motor includes a valve element that is shiftable between an open position and a closed position for controlling pressure air flow through the pressure air inlet passage, and a spring which continuously biases the valve element toward open position. An air compressor is driven by the rotor to deliver an output pressure, which is responsive to a speed of the rotor, to an activating surface of the valve element. The activating surface of the valve element is acted upon by the output pressure of the air compressor to shift the valve element toward the closed position against the bias force of the spring at rotor speed levels exceeding a desired operating speed level.

20 Claims, 1 Drawing Sheet

PNEUMATIC HIGH SPEED MOTOR WITH PRESSURE ACTIVATED SPEED GOVERNOR

This application is a U.S. National Phase Application under 35 USC 371 of International Application PCT/SE2003/001575 filed Oct. 10, 2003.

FIELD OF THE INVENTION

The invention relates to a pneumatic high speed motor provided with a pressure air inlet flow controlling speed governor valve as stated in the claims.

BACKGROUND OF THE INVENTION

A problem concerned with speed control of high speed motors, for instance air turbines, is that mechanical speed governors are difficult to get to operate properly at high speed levels due to high dynamic forces, balancing problems etc.

One way of solving this problem is described in U.S. Pat. No. 5,314,299 wherein the rotation speed of a power tool air turbine is governed by a pressure air inlet flow controlling valve which is activated by the air pressure in a pressure sensing opening in the turbine stator. A co-operation between the pressure sensing opening and an oppositely located idle running nozzle in the turbine stator results in a speed responsive activation pressure to be applied on the air inlet flow controlling valve. This previously known device is less advantageous in that it is difficult to obtain an accurate enough control of the motor speed level.

SUMMARY OF THE INVENTION

The main object of the invention is to provide a pneumatic high speed motor with a pressure controlled speed governor coping with high speed operation and giving an improved speed control accuracy.

Another object of the invention is to provide a pneumatic high speed motor with an improved speed governor enabling a simple and compact motor design.

Further objects and advantages of the invention will appear from the following specification and claims.

According to one aspect of the present invention, a speed governor is provided for a pneumatic high speed motor, wherein the pneumatic high speed motor includes a stator housing, a rotor journalled in the stator housing, and a pressure air inlet passage. The speed governor includes a valve element that is shiftable between an open position and a closed position for controlling pressure air flow through the inlet passage, and a spring which continuously biases the valve element toward the open position. The valve element has an activating surface which is exposed to an output pressure of an air compressor that is driven by the rotor such that the output pressure is responsive to a speed of the rotor. The output pressure of the air compressor generates an activating force, which is responsive to the output pressure, on the activating surface the valve element such that, when the speed of the rotor exceeds a desired operating speed level, the activating force shifts the valve element toward the closed position against the bias force of the spring.

Alternative embodiments of the invention are below described in detail with reference to the accompanying drawings.

DETAILED DESCRIPTION

Figure 1:
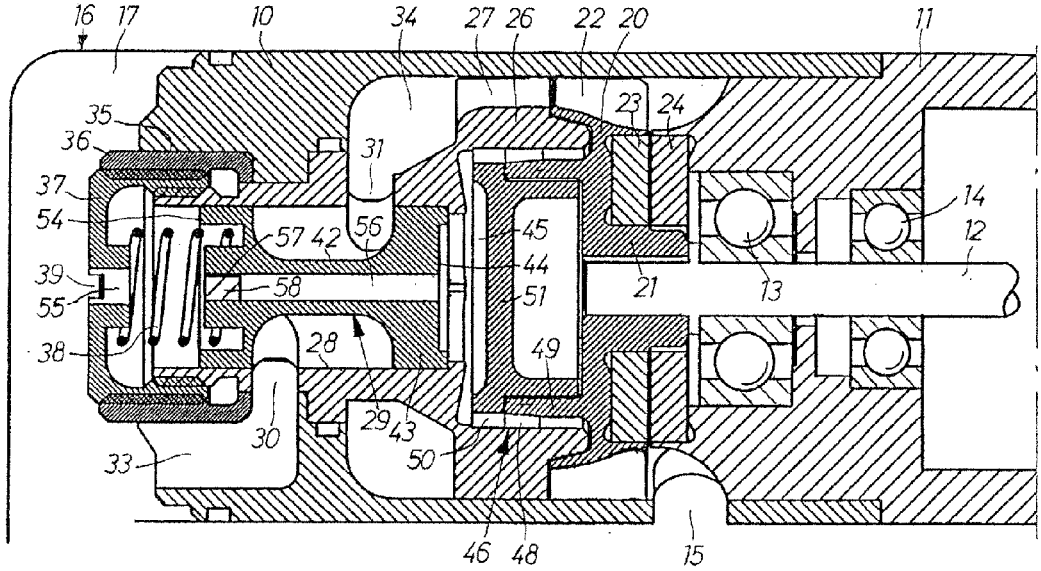
FIG. 1 shows a longitudinal section through a motor according to one embodiment of the invention.

The turbine motor illustrated in the drawing figures comprises a stator housing 10 which at its one end is rigidly secured to a transmission casing 11 supporting a drive spindle 12 via two spindle bearings 13,14. At its opposite end the stator housing 10 is connected to a support and pressure air inlet housing 16 including a pressure air inlet chamber 17 communicating with a pressure air source via a suitable conduit connection (not shown). Exhaust air from the motor is vented through a lateral outlet opening 15.

A turbine rotor 20 is journalled in the stator housing 10 via the bearings 13,14 and has a concentric socket portion 21 for connection to the drive spindle 12. The rotor 20 carries a circumferential row of drive blades 22 to be acted upon by pressure air as described below.

For dealing with the axial load acting on the rotor 20 during operation, there is provided a magnetic type thrust bearing which provides not only an extremely low frictional resistance between the rotor 20 and the housing 10 but also a large load transferring capacity in relation to its physical dimensions. The magnetic thrust bearing comprises two magnetic discs 23,24 which are arranged to act repellent on each other to balance the axial load on the rotor 20 and keep up a clearance between them. One of the magnetic discs 23 is mounted on the rotor 20 whereas the other disc 24 is mounted on the stator housing 10.

The stator housing 10 includes a pressure air ducting stator body 26 which is provided with a circumferential row of air flow linking guide vanes 27 located concentrically with and in a close relationship to the rotor drive blades 22. The stator body 26 is formed with a valve bore 28 for guiding a movable speed governor valve element 29. The stator body 26 has radial openings 30 and 31 for communicating pressure air into and out of the valve bore 28, respectively, whereof the opening 30 communicate with a pressure air source via an inlet passage 33 in the stator housing 10, and the opening 31 communicate with the guide vanes 27 via a feed passage 34.

At the rear end of the stator housing 10 there is a socket portion 35 in which is received a lock sleeve 36. The latter is arranged to abut the against the bottom of the socket portion 35 and has an internal thread for engaging an external thread of an end cap 37 which forms an adjustable support for a bias spring 38 acting on the valve element 29. The end cap 37 is provided with an internal thread for engagement with an external thread on the stator body 26 for making the end cap 37 adjustable. The end cap 37 has a transverse slot 39 for engagement with for instance a screw driver for facilitating adjustment of the pretension of the spring 38. The lock sleeve 36 is provided with external spanner grip surfaces 41 for tightening the lock sleeve 36 against the bottom of the socket portion 35 and thereby locking the end cap 37 against unintentional rotation.

The valve element 29 comprises a waist portion 42 and an inner cylindrical portion 43 and is movable between an open position, illustrated in FIG. 1, and a closed position. The waist portion 42 always keeps the opening 30 uncovered, no matter the position of the valve element 29. In the open position of the valve element 29 the waist portion 42 provides full communication between the openings 30 and 31, but in the closed position of the valve element 29 the cylindrical portion 43 fully covers the opening 31. The bias spring 38 exerts continuously a bias force on the valve element 29 in the direction of the open position.

The valve element 29 has an inner end surface 44 defining partly an activation chamber 45 which is connected to an air compressor 46 generating a valve activating air pressure. This air compressor 46 is an axial flow type turbo compressor which comprises rotor blades 48 formed integral with a tubular neck portion 49 on the turbine rotor 20, and outlet guide vanes 50 formed on a wall element 51 mounted in the stator body 26. The compressor 46 is fed with pressure air via a feed tube 52 which extends through the stator body 26 from the pressure air inlet chamber 17 to a passage 53 in the stator body 26. This passage 53 extends to the upstream end of the rotor blades 48. Accordingly, the compressor 30 is fed with pressure air of the same pressure as the turbine rotor 20 is powered by, and the output pressure of the compressor 46 is amplified to a still higher level. The pressure amplification accomplished by the compressor is responsive to the actual speed of the motor rotor.

Moreover, the valve element 29 has an outer end surface 54 which is acted upon in the direction of the closed position of the valve element 29 by the air pressure supplied from the inlet chamber 17 via an opening 55 in the end cap 37. This means that the valve element 29 is balanced between on one hand the bias force of the spring 38 together with the air pressure in the inlet chamber 17 acting on the end outer surface 54, and on the other hand the outlet pressure of the compressor 46 acting upon the inner end surface 44.

Figure 2:
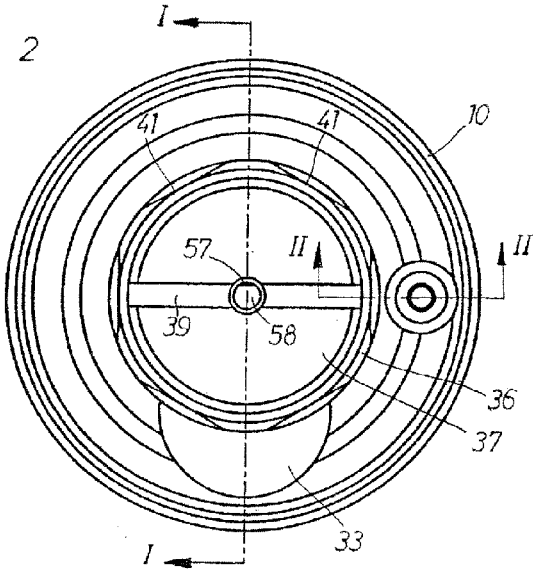
FIG. 2 shows an end view of the stator housing and the governor valve assembly.
Figure 3:
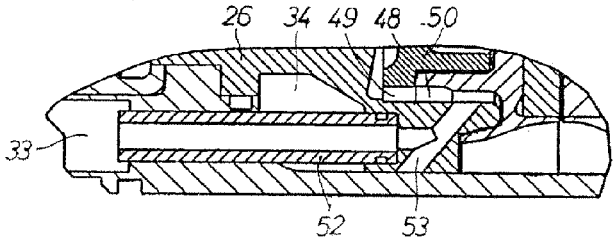
FIG. 3 shows a fractional view along line III—III in FIG. 2 illustrating an air supply passage through the stator housing.

For enabling the pressure on the inner end surface 44 to decrease when the compressor outlet pressure and flow decreases there is provided a central passage 56 through the valve element 29 and a leak opening 57 past an end closure 58 in the passage 56. See FIGS. 1 and 2.

At motor speeds exceeding a predetermined level, the activating air pressure generated by the compressor 46 is high enough to generate an activating force on the end surface 44 of the valve 29 strong enough to dominate over the bias force exerted by the spring 38. Thereby, the valve 29 will move in its closing direction, i.e. to the left in FIG. 1, to make the cylindrical portion 43 at least partly cover the opening 31 such that the air flow to the guide vanes 27 and the rotor blades 22 is reduced and the rotor speed is limited to the predetermined level.

If the rotor speed is suddenly decreased, for instance by a sudden load increase on the motor, the high compressor boosted air pressure acting on the inner valve surface 44, is able to decrease rather quickly through the passage 56 and the leak opening 57 which communicate with the air inlet chamber 17. This means that the bias spring 38 is able to move the governor valve element 29 in the opening direction to increase the motor power in response to the increased load level, thereby keeping up the speed of the rotor 20.

It is to be understood that the invention is not limited to the illustrated and described example but may be freely varied within the scoop of the claims. For instance, the air compressor is not limited to the axial flow type turbo compressor but could as well be a radial flow type turbo compressor or a screw compressor.

Likewise, the axial thrust bearing of the turbine rotor is not limited to the described magnetic type but can be a roller type bearing in such embodiments of the invention where the axial load on the turbine rotor is of a lower magnitude.

The invention claimed is:

1. A speed governor for a pneumatic high speed motor, wherein the pneumatic high speed motor includes a stator housing, a rotor journalled in said stator housing, and a pressure air inlet passage, said speed governor comprising:

a valve element that is shiftable between an open position and a closed position for controlling pressure air flow through said inlet passage; and a spring which continuously biases said valve element toward said open position;

wherein said valve element comprises an activating surface which is exposed to an output pressure of an air compressor that is driven by said rotor such that the output pressure is responsive to a speed of said rotor; and wherein the output pressure of the air compressor generates an activating force, which is responsive to the output pressure, on said activating surface of said valve element such that, when the speed of the rotor exceeds a desired operating speed level, the activating force shifts said valve element toward said closed position against the bias force of said spring.

2. The speed governor according to claim 1, wherein said valve element is rotation symmetric, and said activating surface is formed by an end surface of said valve element.

3. The speed governor according to claim 1, wherein said spring is pre-tensioned by a support member that is adjustably mounted in the stator housing.

4. The speed governor according to claim 1, wherein said air compressor is a turbo compressor.

5. The speed governor according to claim 4, wherein said turbo compressor is an axial flow type turbo compressor.

6. The speed governor according to claim 4, wherein said turbo compressor comprises a rotor integrated with said rotor of the pneumatic high speed motor.

7. The speed governor according to claim 2, wherein said spring is pre-tensioned by a support member that is adjustably mounted in the stator housing.

8. The speed governor according to claim 2, wherein said air compressor is a turbo compressor.

9. The speed governor according to claim 3, wherein said air compressor is a turbo compressor.

10. The speed governor according to claim 7, wherein said air compressor is a turbo compressor.

11. The speed governor according to claim 8, wherein said turbo compressor is an axial flow type turbo compressor.

12. The speed governor according to claim 9, wherein said turbo compressor is an axial flow type turbo compressor.

13. The speed governor according to claim 10, wherein said turbo compressor is an axial flow type turbo compressor.

14. The speed governor according to claim 8, wherein said turbo compressor comprises a rotor integrated with said rotor of the pneumatic high speed motor.

15. The speed governor according to claim 9, wherein said turbo compressor comprises a rotor integrated with said rotor of the pneumatic high speed motor.

16. The speed governor according to claim 10, wherein said turbo compressor comprises a rotor integrated with said rotor of the pneumatic high speed motor.

17. The speed governor according to claim 11, wherein said turbo compressor comprises a rotor integrated with said rotor of the pneumatic high speed motor.

18. The speed governor according to claim 12, wherein said turbo compressor comprises a rotor integrated with said rotor of the pneumatic high speed motor.

19. The speed governor according to claim 13, wherein said turbo compressor comprises a rotor integrated with said rotor of the pneumatic high speed motor.

20. A pneumatic high speed motor, comprising:

a stator housing;

a rotor journalled in the stator housing;

a pressure air inlet passage;

a speed governor valve element that is shiftable between an open position and a closed position for controlling pressure air flow through the inlet passage;

a spring which continuously biases the valve toward the open position; and an air compressor that is driven by the rotor such that an output pressure of the air compressor is responsive to a speed of the rotor;

wherein the valve element comprises an activating surface which is exposed to the output pressure of the air compressor, and the output pressure of the air compressor generates an activating force, which is responsive to the output pressure, on the activating surface of the valve element such that, when the speed of the rotor exceeds a desired operating speed level, the activating force shifts the valve element toward the closed position against the bias force of the spring.

* * * * *